US008100563B2

(12) United States Patent
Abdelsamed et al.

(10) Patent No.: US 8,100,563 B2
(45) Date of Patent: Jan. 24, 2012

(54) REFLECTOR ASSEMBLY FOR A LUMINAIRE

(75) Inventors: Yaser S. Abdelsamed, Granville, OH (US); Jack L. Ries, Granville, OH (US)

(73) Assignee: ABL IP Holding LLC, Conyers, GA (US)

( * ) Notice: Subject to any disclaimer, the term of this patent is extended or adjusted under 35 U.S.C. 154(b) by 0 days.

(21) Appl. No.: 11/623,487

(22) Filed: Jan. 16, 2007

(65) Prior Publication Data

US 2008/0170394 A1 Jul. 17, 2008

(51) Int. Cl.
*F21V 7/00* (2006.01)

(52) U.S. Cl. ..... 362/296.01; 362/297; 362/310; 362/296.05

(58) Field of Classification Search ..... 362/296, 362/299–300, 311, 516–519, 344, 296.01, 362/297, 310, 296.05
See application file for complete search history.

(56) References Cited

U.S. PATENT DOCUMENTS

| | | | | | |
|---|---|---|---|---|---|
| 1,199,071 | A * | 9/1916 | Heckert | ..... | 362/304 |
| 1,583,269 | A * | 5/1926 | Blasius | ..... | 362/344 |
| 2,003,687 | A * | 6/1935 | Graham | ..... | 362/344 |
| 2,257,419 | A * | 9/1941 | Kurz | ..... | 362/307 |
| 4,232,361 | A * | 11/1980 | Kelsall | ..... | 362/364 |
| 4,931,912 | A * | 6/1990 | Kawakami et al. | ..... | 362/547 |
| 5,036,445 | A * | 7/1991 | Osteen | ..... | 362/348 |
| 5,113,331 | A * | 5/1992 | Nagengast | ..... | 362/267 |
| 5,180,219 | A * | 1/1993 | Geddie | ..... | 362/546 |
| 6,286,985 | B1 * | 9/2001 | Ohshio et al. | ..... | 362/512 |
| 6,301,770 | B1 * | 10/2001 | McIlwraith | ..... | 29/527.2 |
| 2001/0019483 | A1 * | 9/2001 | Takada | ..... | 362/517 |
| 2001/0033432 | A1 * | 10/2001 | Clark | ..... | 359/742 |

FOREIGN PATENT DOCUMENTS

| | | |
|---|---|---|
| GB | 2151763 | 7/1985 |
| WO | WO 00/01985 | 1/2000 |

OTHER PUBLICATIONS

International Search Report and Written Opinion for PCT/US2008/00584 filed Jan. 16, 2008.
Supplementary European Search Report for EP 08 724551 (PCT/US2008/000584) issued Jan. 4, 2011.

* cited by examiner

*Primary Examiner* — Robert May
(74) *Attorney, Agent, or Firm* — Ballard Spahr LLP

(57) ABSTRACT

The present invention relates to a reflector assembly for a luminaire where the reflector assembly comprises an anti-static member disposed between a lamp of the luminaire and a reflector body. In various aspects the anti-static member may be glass, plastic or other transparent or translucent materials and the reflector may be substantially sealed from the atmosphere by the anti-static member or the anti-static member in cooperation with a cover of the reflector assembly.

14 Claims, 6 Drawing Sheets

REFLECTOR ASSEMBLY FOR A LUMINAIRE

FIELD OF THE INVENTION

The present invention generally pertains to lighting fixtures and more particularly to open fixture luminaires.

BACKGROUND OF THE INVENTION

Luminaires, or lighting fixtures, available in the market today are generally either open fixtures or closed fixtures. As can be seen in FIG. 1, open fixtures 102 are those with the optical system open to the environment, whereas closed fixtures 104 are sealed. The optical system is generally comprised of a lamp 106 and a reflector 108. In closed fixtures 104, a glass, plastic or other translucent or transparent lens 110 encloses the reflector 108 to allow for light to exit the aperture 112.

Open luminaires 102 incorporate glass, plastic or metal reflective optics 108. In many instances, these designs may have inherent challenges that affect the fixture. For instance, in many situations plastic yellows or discolors from ultraviolet (UV) exposure and heat resulting in decreased reflective properties. Plastic may also exhibit a static charge build-up, especially when exposed to moving air. The static charge increases dirt particle buildup through ionic attraction on the plastic, further reducing light transmission and reflection and exacerbating discoloring because of increased heat buildup. In some installations, use of UV-resistant acrylic compounds may delay the discoloring effect, but the material still degrades over time. Optics 108 comprised of glass generally do not degrade and stay clean longer due to the non-static properties of glass.

In some instances the reflective optics 108 are comprised of metallic materials. While metallic reflective optics generally do not degrade from UV exposure, they may be vulnerable to oxidation, which attacks the coatings used to cause reflectivity. Also, ungrounded metal may exhibit a static charge such that dirt particles are attracted to the reflective surface, accumulate, and reduce optical performance. Cleaning or wiping away the dirt from a specular metal surface is laborious and may create scratches on the surface, further degrading reflective performance.

In other instances reflective optics comprise glass or plastic coated with specular metal (through processes such as sputtering or vapor deposition), thereby creating reflectivity. While this approach may overcome some of the challenges described above, it is expensive, is geometry-dependent and is highly susceptible to damage such as scratches, chemical breakdown and dirt depreciation.

Furthermore, it is generally recognized that the optical performance of all luminaires changes over time depending upon the environment in which they are placed. Luminaire dirt depreciation ("LDD") is one of the many factors used by the lighting industry to determine how many luminaires are needed to generate the recommended amount of light for the situation. Generally, the higher the LDD, the better the luminaire performs over time, thereby reducing the required fixtures needed in an installation. Studies conducted by groups such as the Illuminating Engineering Society of North America (IESNA) show that luminaires have different rates of performance deterioration due to dirt accumulation depending upon the cleanliness of the environment and the configuration of the fixture.

Productivity decreases with dropping light levels and maintenance is required to clean away the dirt and increase performance. Plastic lenses must generally be replaced on a periodic basis (e.g., every 3-5 years), all which adds up to extra cost for the owner. Therefore, what is needed is an inexpensive, reflector-based luminaire that overcomes many of the challenges found in the art, some of which are described above.

SUMMARY

In one embodiment according to the present invention, a reflector assembly for a luminaire is provided. The luminaire comprises a housing and at least one lamp extending from the housing. The reflector assembly is comprised of a reflector body configured to engage a portion of the housing. At least a portion of the reflector body substantially envelops at least a portion of the lamp and the reflector body has an interior face proximate the lamp that comprises a reflective surface. The reflector assembly is further comprised of at least one anti-static member such that the anti-static member is substantially intermediate the interior face of the reflector body and the at least one lamp.

In one aspect, the reflector assembly comprises at least one anti-static member substantially overlies the interior surface of the reflector body.

In another aspect, the reflector assembly comprises the at least one anti-static member substantially conforming to the shape of the interior surface of the reflector body.

In another aspect of the reflector assembly, a portion of the at least one anti-static member is spaced therefrom the reflector body.

In another aspect of the reflector assembly, the at least one anti-static member comprises a plurality of anti-static members.

In one aspect of the reflector assembly, the at least one anti-static member comprises glass.

In another aspect of the reflector assembly, the reflector body comprises a substantially parabolic shape.

In another aspect of the reflector assembly, the at least one lamp comprises a plurality of lamps.

In yet another aspect, the reflector assembly further comprises a cover substantially overlying at least a portion of an exterior face of the reflector body.

In another aspect of the reflector assembly, the at least one anti-static member and the cover substantially enclose the reflector body.

In another aspect of the reflector assembly, the cover comprises a metallic material.

In another aspect of the reflector assembly, the cover comprises an anti-static material.

In yet another aspect of the reflector assembly, the anti-static material is glass.

Additional advantages of the invention will be set forth in part in the description which follows, and in part will be obvious from the description, or may be learned by practice of the invention. It is to be understood that both the foregoing general description and the following detailed description are exemplary and explanatory only and are not restrictive of the invention.

DETAILED DESCRIPTION OF THE DRAWINGS

The accompanying drawings, which are incorporated in and constitute a part of this specification, illustrate certain aspects of the instant invention and together with the description, serve to explain, without limitation, the principles of the invention and like reference characters used therein indicate like parts throughout the several drawings.

DETAILED DESCRIPTION

Figure 1:
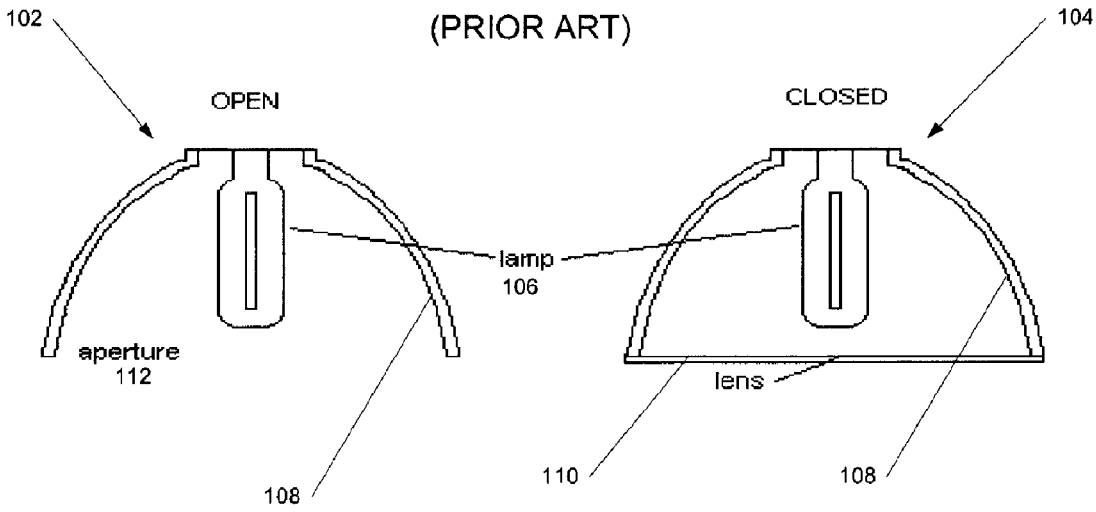
FIG. 1 is an illustration of exemplary open and sealed luminaires, as are known in the art.

The present invention may be understood more readily by reference to the following detailed description of the invention and the examples included therein and to the figures and their previous and following description.

Before the present systems, articles, devices, and/or methods are disclosed and described, it is to be understood that this invention is not limited to specific systems, specific devices, or to particular methodology, as such may, of course, vary. It is also to be understood that the terminology used herein is for the purpose of describing particular embodiments only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used in the specification and the appended claims, the singular forms "a," "an" and "the" include plural referents unless the context clearly dictates otherwise. Thus, for example, reference to "a reflector" includes two or more such reflectors, and the like.

Ranges can be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that when a value is disclosed that "less than or equal to" the value, "greater than or equal to the value" and possible ranges between values are also disclosed, as appropriately understood by the skilled artisan. For example, if the value "10" is disclosed the "less than or equal to 10" as well as "greater than or equal to 10" is also disclosed. It is also understood that throughout the application, data is provided in a number of different formats and that this data represents endpoints and starting points, and ranges for any combination of the data points. For example, if a particular data point "10" and a particular data point 15 are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

"Optional" or "optionally" means that the subsequently described event or circumstance may or may not occur, and that the description includes instances where said event or circumstance occurs and instances where it does not.

Figure 2:
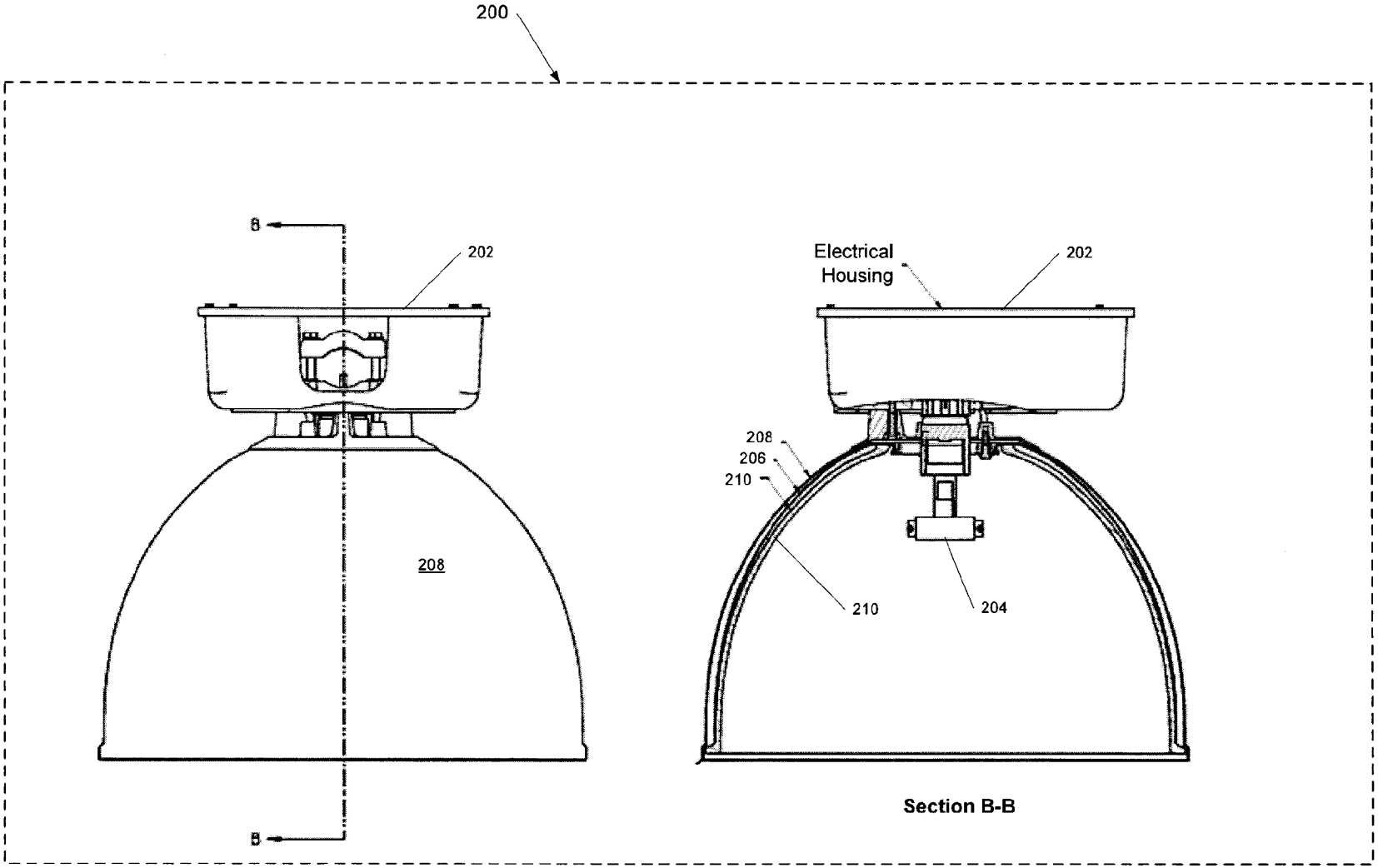
FIG. 2 is a line drawing of an exemplary embodiment of a luminaire, also showing a cross-sectional view, according to the present invention.

One embodiment according to the present invention provides a reflector assembly for a luminaire. FIG. 2 is a line drawing of an exemplary embodiment of a luminaire 200. As shown in the embodiment of FIG. 2, the luminaire 200 is comprised of a housing 202 and a lamp 204 that connectively engages with at least a portion of the housing 202. In the illustrated embodiment, electrical connections for energizing the lamp 204 are substantially contained within the housing 202. Further comprising the luminaire 200 is a reflector panel 206 that, in this embodiment, is incorporated into a cover 208. For instance, the reflector panel 206 may be a specular metallic coating or some other reflective material applied to the inner face of the cover 208. In other embodiments, the reflector panel 206 may be a separate reflector body that is contained substantially within the cover 208. The reflector panel 206 may be comprised of plastic having a specular metallic coating or some other reflective material applied, or anodized metals such as, for example, aluminum, magnesium, titanium, and tantalum. The cover 208 shown in the embodiment of FIG. 2 is comprised of spun aluminum, though it may be comprised of materials such as plastics, steel, glass, etc., or combinations of materials, in other embodiments.

Also shown in the embodiment according to FIG. 2 is an anti-static member 210 comprised in this instance of glass that is contained substantially within the cover 208, proximate to the lamp 204, and intermediate to the cover 208 and the lamp 204. In other words, the anti-static member 210 is substantially between the reflector panel 206 and the lamp 204. As shown in FIG. 2, it is not required that the anti-static member 210 be in contact with the reflector panel 206 or cover 208, though such contact is not prohibited. While the anti-static member 210 shown in FIG. 2 is shown as being comprised of glass, it is to be appreciated that it may also be comprised of substantially transparent materials such as plastics or translucent materials. In the embodiment of FIG. 2, the anti-static member 210 is connectively engaged with the cover 208, and the cover 208 is connectively engaged with the housing 202 for structural integrity and support purposes. It is also to be appreciated that while the embodiment of FIG. 2 shows the anti-static member 210 and the cover 208 forming a seal such that the reflector panel 206 is substantially sealed from the external environment, that in other embodiments the reflector panel 206 may not be sealed.

Figure 3:
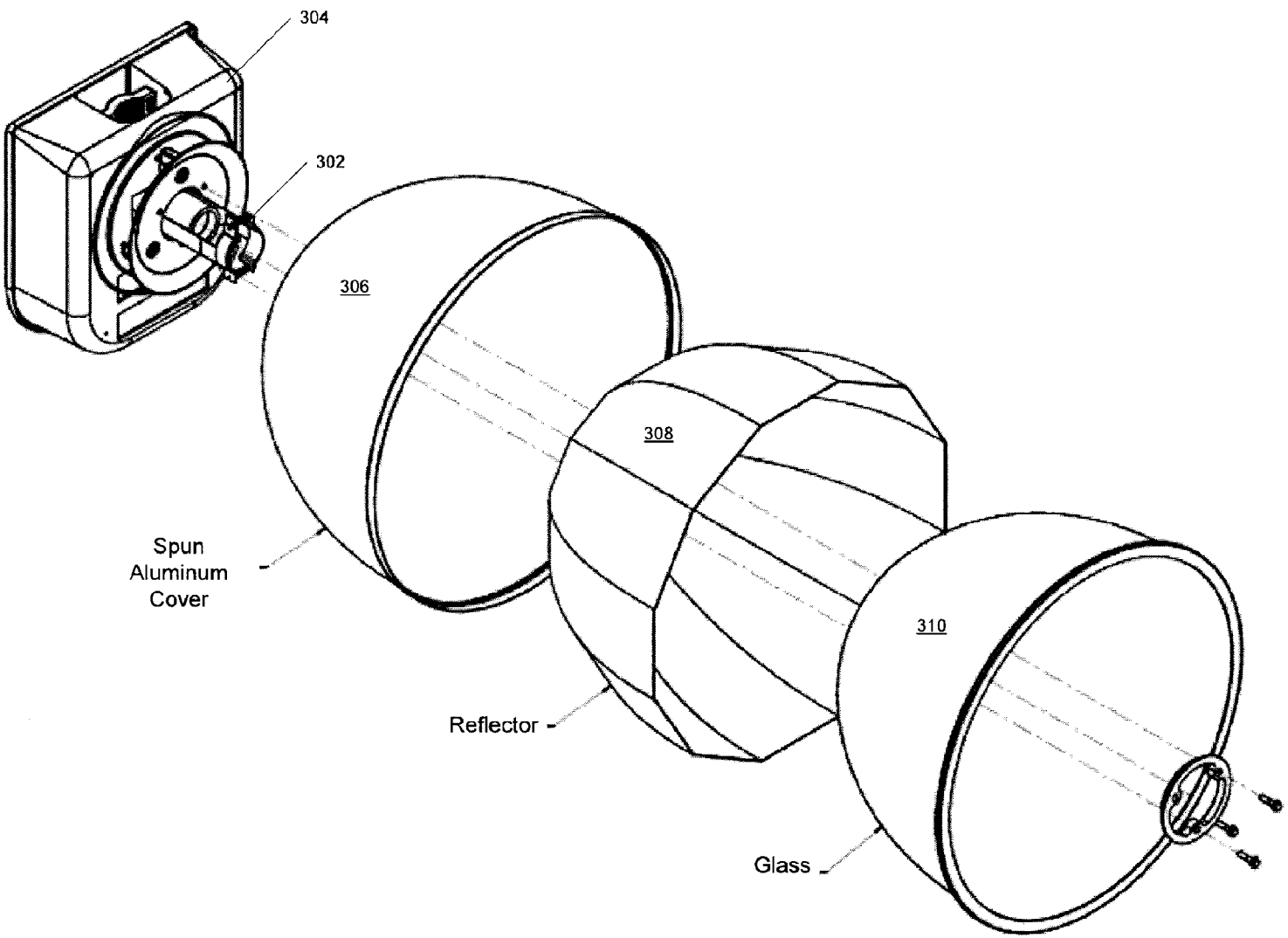
FIG. 3 is an exploded view of another exemplary embodiment of a luminaire comprising an anti-static member.

FIG. 3 is an exploded view of another exemplary embodiment of a luminaire comprising an anti-static member. As shown in FIG. 3, a protrusion 302 from the housing 304 extends through a reflector assembly comprised in this instance of a cover 306, reflector panel 308, and static member 310, thereby connectably engaging the reflector assembly with the housing 304 and providing a means for attaching and energizing a lamp (not shown in FIG. 3). In the embodiment according to FIG. 3, it is to be appreciated that the reflector panel 308 is not incorporated into the cover 306 as it was in the embodiment according to FIG. 2. It is also to be appreciated in FIG. 3 that the reflector panel 308 is formed in a geometric shape that differs from that of the cover 306 and the static member 310.

Figure 4:
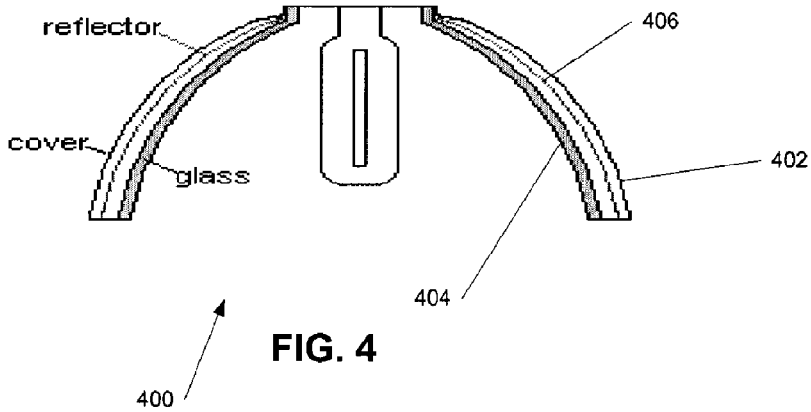
FIG. 4 is an illustration of an exemplary embodiment of a reflector assembly comprising an anti-static member.

FIG. 4 is an illustration of another exemplary embodiment of a reflector assembly comprising an anti-static member. The reflector assembly 400 is comprised of a cover 402 and an anti-static member 404 and disposed therebetween the cover 402 and the anti-static member 404 is a reflector 406, such that the reflector 406 is substantially sealed between the cover 402 and the anti-static member 404. The reflector 406 may be a separate member or it may be reflective material deposited on the inner surface of the cover 402 or the outer surface of the anti-static member. Because of the anti-static member 404 being disposed between the lamp 408 and the reflector 406, the anti-static member 404 should at least be translucent and preferably transparent. In the embodiment of FIG. 4, the anti-static member 404 is comprised of glass, though it is to be appreciated that other translucent or transparent materials may be used. Glass is chemically stable, is not affected by UV, and is capable of withstanding significant temperature and temperature gradients across its surface. Light levels from the lamp will not significantly decrease due to reflector erosion as the anti-static member 404 protects the reflector 406 and maintains its specular properties. An advantage of the embodiment according to FIG. 4 is that dirt build-up on the reflector 406 is reduced over conventionally-designed luminaries. Thus, fewer fixtures are required to light an installation and less maintenance is needed because little or no cleaning of the anti-static member 404 is required. Additionally, when the fixture is designed with an open top and bottom, natural convection is allowed to flow air through the system, establishing a self-cleaning effect that continuously moves dirt away from the surface. The flow-through effect also improves thermal management as convection next to the lamp and glass moves heat from the system.

Figure 5:
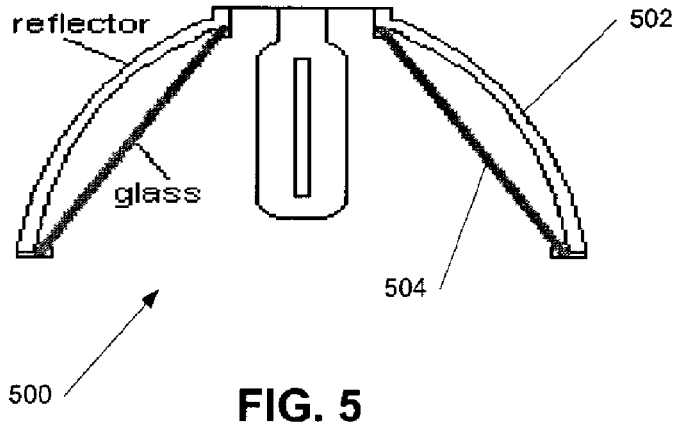
FIG. 5 is an exemplary cross-sectional view of a reflector assembly comprising a parabolic-shaped reflector and a conical-shaped anti-static member.
Figure 6:
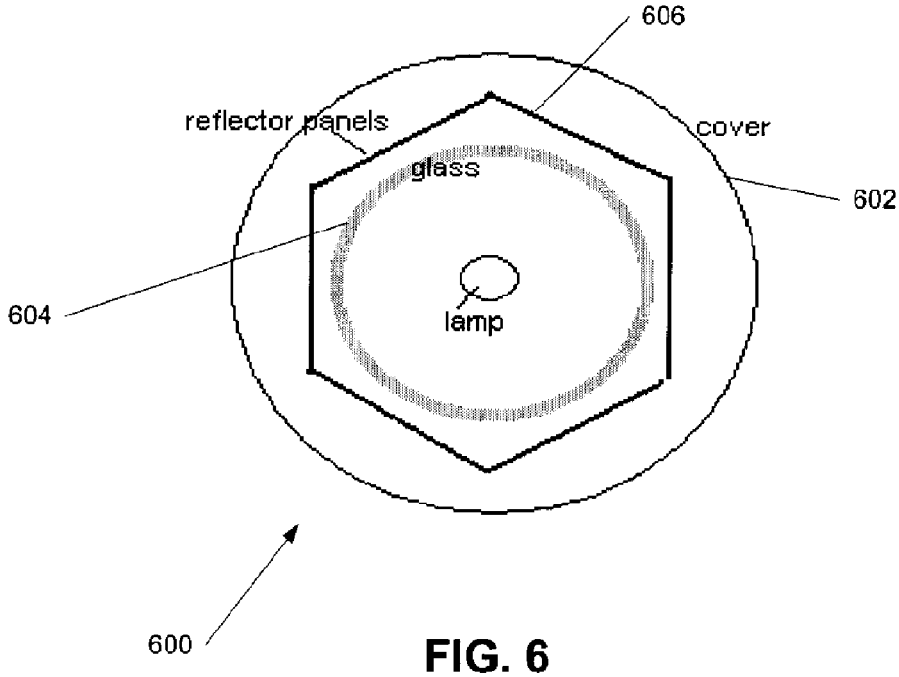
FIG. 6 is an end-view of an exemplary reflector assembly comprising a parabolic-shaped cover, a parabolic-shaped anti-static member, and a hexagonal-shaped reflector.

Various geometrical shapes may be utilized in the manufacture of a reflector assembly according to the present invention. For example, FIG. 5 is an exemplary cross-sectional view of a reflector assembly 500 comprising a parabolic-shaped reflector 502 and a conical-shaped anti-static member 504. FIG. 6 is an end-view of an exemplary reflector assembly 600 comprising a parabolic-shaped cover 602, a parabolic-shaped anti-static member 604, and a hexagonal-shaped reflector 606. In some instances one or more of the reflector, the cover and the anti-static member may be asymmetric in order to provide directional lighting. The anti-static member may be bundled with many alternative reflector shapes or a glass refractor can be added to the system for further light control.

Figure 7C:
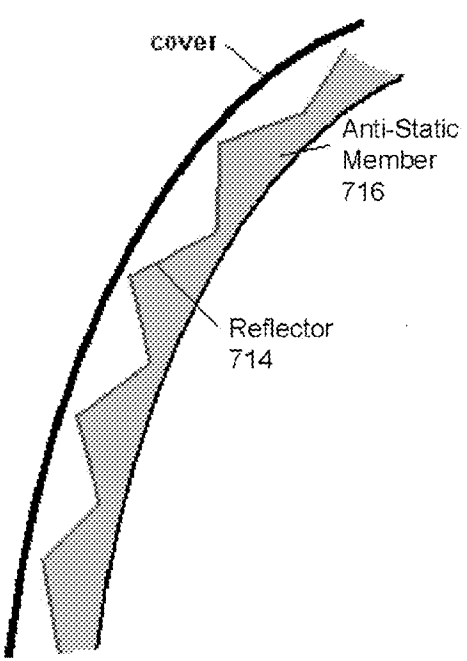
FIGS. 7A-7D illustrate exemplary segments of cross-sectional views of various reflector assembly embodiments according to the present invention.
Figure 7B:
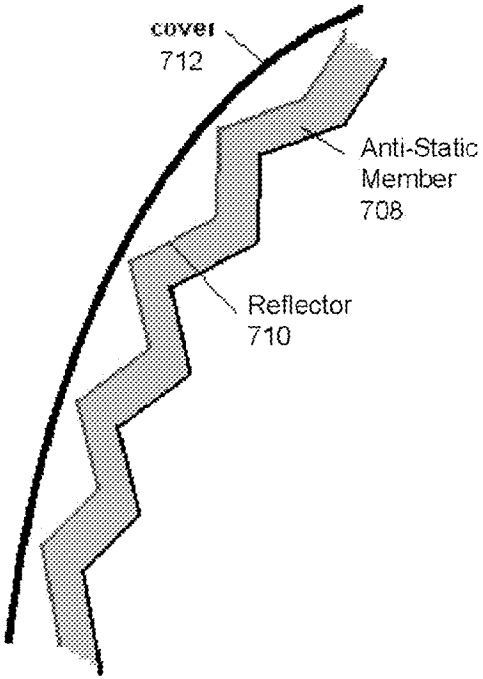
Figure 7A:
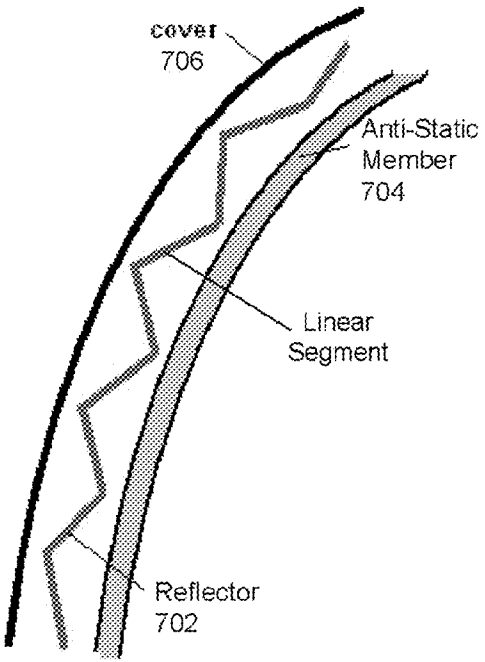

FIGS. 7A-7D illustrate segments of cross-sectional views of various reflector assembly embodiments according to the present invention. FIG. 7A illustrates an embodiment where a pre-formed and pre-anodized reflector 702 is disposed between an anti-static member 704 and a cover 706. The space between the cover 706 and the anti-static member 704 may, or may not be substantially sealed from the atmosphere in which the reflector assembly is placed. The design of the reflector assembly in the embodiment according to FIG. 7A allows asymmetric reflector 702 design in an overall symmetric geometry for the reflector assembly. It also provides high specularity for the reflector 702.

FIG. 7B illustrates an embodiment where an anti-static member 708 is formed to the shape of a pre-formed and pre-anodized reflector 710. In this instance, the reflector 710 may be a separate member from the cover 712, or it may be incorporated into the cover 712. In the embodiment according to FIG. 7B, the anti-static member 708 is conformed to the shape of the reflector 710 by one or more of, for example, a low temperature softening process, blow-molding the member 708 onto the reflector 710, or any other process that conforms the anti-static member 708 to the reflector 710. In this way the inner surface of the anti-static member 708 (the surface proximate the lamp), the outer surface of the anti-static member 708 (the surface distal the lamp), and the inner surface of the reflector 710 all have substantially the same shape.

FIG. 7C is similar to the embodiment of FIG. 7B, however in the embodiment according to FIG. 7C the reflector 714 is pressed onto the anti-static member 716 such that the reflector 714 adopts the shape of the anti-static member 716, rather than the anti-static member conforming to the shape of the reflector as is shown in FIG. 7B. In this way the inner surface of the anti-static member 716 (the surface proximate the lamp) and the outer surface of the anti-static member 716 (the surface distal the lamp) may have different geometric shapes, while the inner surface of the reflector 714 and the outer surface of the anti-static member 716 have substantially the same shape.

Figure 7D:
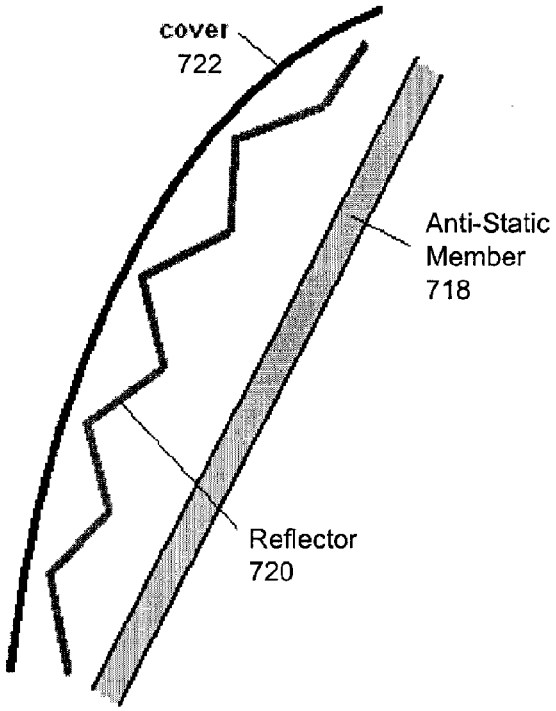

FIG. 7D illustrates an embodiment of a reflector assembly where an anti-static member 718 may be straight, formed, or a combination. As previously described, the reflector body 720 may be a separate member or may be incorporated into the cover 722.

Figure 8:
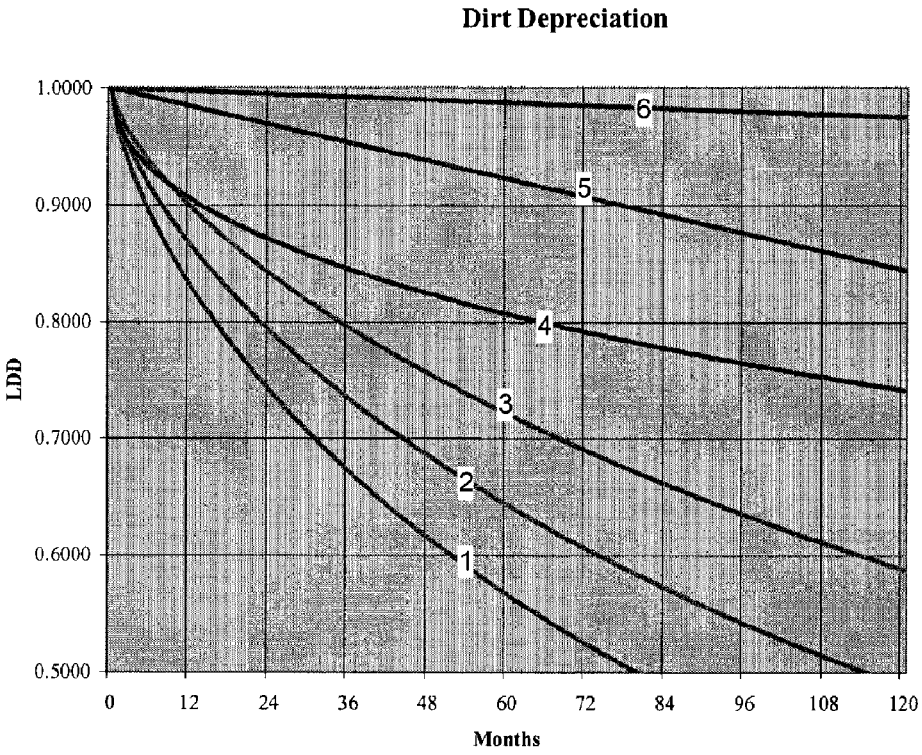
FIG. 8 is an exemplary graphical illustration of luminaire dirt depreciation over time.

FIG. 8 is an exemplary graphical illustration of luminaire dirt depreciation over time. Generally, this graph shows the loss of lumens or light output over time caused by the build-up of dirt and debris on luminaires in three different environments; clean, medium, and dirty, which correspond to the amount of dirt and particulates that a luminaire may be exposed to. Lines 1, 2 and 3 correspond to the average loss of lumens caused by luminaire dirt depreciation as determined by the IESNA in dirty, medium and clean environments, respectively. These are to be compared with the performance of luminaires incorporating a sealed reflector with an anti-static member in accordance with one or more embodiments of the present invention. As can be seen in curves 4, 5, and 6, which correspond to dirty, medium and clean environments, respectively, the performance of luminaires incorporating a sealed reflector with an anti-static member is improved over that of conventional luminaries.

Although not specifically shown in the Figures, it is contemplated within the scope of the invention that the anti-static member may be comprised of one or more separate sections such that the anti-static member is comprised of a plurality of anti-static members. It is also to be appreciated that the lamp may be comprised of one lamp or a plurality if lamps in various aspects according to the present invention.

Although several aspects of the present invention have been disclosed in the foregoing specification, it is understood by those skilled in the art that many modifications and other aspects of the invention will come to mind to which the invention pertains, having the benefit of the teaching presented in the foregoing description and associated drawings. It is thus understood that the invention is not limited to the specific aspects disclosed hereinabove, and that many modifications and other aspects are intended to be included within the scope of the appended claims. Moreover, although specific terms are employed herein, as well as in the claims which follow, they are used only in a generic and descriptive sense, and not for the purposes of limiting the described invention.

What is claimed is:

1. A reflector assembly for a luminaire comprising:

a housing and at least one lamp extending from the housing;

a reflector body configured to engage a portion of the housing, wherein at least a portion of the reflector body substantially envelops at least a portion of the at least one lamp, and wherein the reflector body has an interior face comprising a reflective surface;

a cover configured to engage a portion of the housing, wherein said cover is separate from the reflector body and the cover substantially overlies at least a portion of an exterior face of the reflector body;

at least one anti-static member configured to engage a portion of the housing, wherein said at least one anti-static member is separate from the reflector body and the cover, wherein the anti-static member is substantially intermediate the interior face of the reflector body and the at least one lamp, the at least one anti-static member substantially overlying the interior face of the reflector body, wherein the at least one anti-static member is spaced from the cover, and wherein the space between the cover and the at least one anti-static member is not sealed from the atmosphere; and a convection means for self-cleaning the at least one anti-static member.

2. The reflector assembly of claim 1, wherein the at least one anti-static member substantially conforms to the shape of the interior face of the reflector body.

3. The reflector assembly of claim 2, wherein a portion of the at least one anti-static member is substantially in contact with the reflector body.

4. The reflector assembly of claim 1 or 2, wherein a portion of the at least one anti-static member is spaced from the reflector body.

5. The reflector assembly of claim 1, wherein the at least one anti-static member comprises glass.

6. The reflector assembly of claim 1, wherein the reflector body has a substantially parabolic shape.

7. The reflector assembly of claim 1, wherein the at least one anti-static member and the cover together substantially enclose the reflector body.

8. The reflector assembly of claim 7, wherein the cover comprises a metallic material.

9. The reflector assembly of claim 7, wherein the cover comprises an anti-static material.

10. The reflector assembly of claim 9, wherein the anti-static material comprises glass.

11. The reflector assembly of claim 1, wherein the convection means for self-cleaning the at least one anti-static member comprises flowing air through an open top and bottom of the assembly.

12. A reflector assembly for a luminaire comprising:

a housing and at least one lamp extending from the housing;

a reflector body configured to engage a portion of the housing, wherein at least a portion of the reflector body substantially envelops at least a portion of the at least one lamp, and wherein the reflector body has an interior face comprising a reflective surface;

a cover configured to engage a portion of the housing, wherein said cover is separate from the reflector body and the cover substantially overlies at least a portion of an exterior face of the reflector body;

at least one anti-static member configured to engage a portion of the housing, wherein said at least one anti-static member is separate from the reflector body and the cover, wherein the anti-static member is substantially intermediate the interior face of the reflector body and the at least one lamp, the at least one anti-static member substantially overlying the interior face of the reflector body; and means for self-cleaning the assembly, wherein the means for self-cleaning the assembly comprises flowing air through an open top and bottom of the assembly.

13. The reflector assembly of claim 12, wherein the air flows through the assembly by natural convection.

14. A reflector assembly for a luminaire comprising:

a housing and at least one lamp extending from the housing;

a reflector body configured to engage a portion of the housing, wherein at least a portion of the reflector body substantially envelops at least a portion of the at least one lamp, wherein the reflector body has an interior face comprising a reflective surface, and wherein the reflector body comprises a plurality of linear segments, each linear segment being positioned at an angle relative to an adjacent segment;

a cover separate from the reflector body and substantially overlying at least a portion of an exterior face of the reflector body;

at least one anti-static member separate from the cover, wherein the anti-static member is substantially intermediate the reflector body and the at least one lamp, and wherein the at least one anti-static member substantially conforms to and overlies the plurality of linear segments of the reflector body; and means for self-cleaning the assembly, wherein the means for self-cleaning the assembly comprises flowing air through an open top and bottom of the assembly.

* * * * *